US012655706B2

(12) United States Patent
Pedersen

(10) Patent No.: US 12,655,706 B2
(45) Date of Patent: Jun. 16, 2026

(54) WELLBORE INSTALLATION APPARATUS AND METHOD OF LOWER AN APPARATUS TO SEABED

(71) Applicant: OneSubsea AS, Oslo (NO)

(72) Inventor: Martin Pedersen, Oslo (NO)

(73) Assignee: OneSubsea AS, Oslo (NO)

( * ) Notice: Subject to any disclaimer, the term of this patent is extended or adjusted under 35 U.S.C. 154(b) by 0 days.

(21) Appl. No.: 19/143,408

(22) PCT Filed: Jan. 29, 2024

(86) PCT No.: PCT/NO2024/050021
§ 371 (c)(1),
(2) Date: Jun. 26, 2025

(87) PCT Pub. No.: WO2024/162857
PCT Pub. Date: Aug. 8, 2024

(65) Prior Publication Data

US 2026/0117613 A1 Apr. 30, 2026

(30) Foreign Application Priority Data

Jan. 30, 2023 (GB) ..... 2301270

(51) Int. Cl.
*E21B 33/03* (2006.01)
*E21B 7/20* (2006.01)
*E21B 33/035* (2006.01)

(52) U.S. Cl.
CPC ..... *E21B 33/035* (2013.01); *E21B 7/20* (2013.01)

(58) Field of Classification Search
CPC ..... E21B 33/035; E21B 7/20
See application file for complete search history.

(56) References Cited

U.S. PATENT DOCUMENTS 3,032,106 A 5/1962 Focht
3,382,921 A 5/1968 Todd
(Continued)

FOREIGN PATENT DOCUMENTS

GB 2501381 A 10/2013
WO 9606260 A1 2/1996
(Continued)

OTHER PUBLICATIONS

International Search Report and Written Opinion of International Patent Application No. PCT/NO2024/050021 dated on Apr. 2, 2024, 11 pages.

*Primary Examiner* — Kyle Armstrong
(74) *Attorney, Agent, or Firm* — Kyle R. Miiller

(57) ABSTRACT

An apparatus (33) for installing a wellbore beneath a body of water comprising a support structure (10, 72), a tubular (22) mounted on the support structure (10, 72), the tubular (22) having a first end (22*a*), a second end (22*b*) and an interior passage (24) which extends from the first end (22*a*) to the second end (22*b*), a tubular extension (34*a*-34*f*) releasably mounted on the support structure (72), the tubular extension (34*a*-34*f*) having a first end, a second end and an interior passage which extends from the first end to the second end, and a flexible assembly line (36) which extends from the interior passage of the tubular extension (34*a*-34*f*) to the second end thereof, into the tubular (22) at the first end (22*a*) thereof, and along the interior passage (24) of the tubular (22) to the second end (22*b*) thereof.

20 Claims, 7 Drawing Sheets

(56) References Cited

U.S. PATENT DOCUMENTS

| | | | | |
|---|---|---|---|---|
| 4,830,541 | A | 5/1989 | Shatto | |
| 7,025,145 | B2 | 4/2006 | Emmerson | |
| 2011/0100710 | A1* | 5/2011 | Fossli | E21B 21/067 175/7 |
| 2013/0126181 | A1 | 5/2013 | Bell | |

FOREIGN PATENT DOCUMENTS

| | | | |
|---|---|---|---|
| WO | 0034618 | A1 | 6/2000 |
| WO | 0165050 | A1 | 9/2001 |
| WO | 2013167872 | A2 | 11/2013 |
| WO | 2022265516 | A1 | 12/2022 |

* cited by examiner

WELLBORE INSTALLATION APPARATUS AND METHOD OF LOWER AN APPARATUS TO SEABED

CROSS-REFERENCE TO RELATED APPLICATIONS

This application is the National Stage Entry of International Application No. PCT/NO2024/050021, filed Jan. 29, 2024, which claims priority to G.B. Patent Application No. 2301270.1, filed on Jan. 30, 2023.

The present invention relates to a wellbore installation apparatus and associated methods.

BACKGROUND

Subsea wellbores can be drilled using a dedicated drilling vessel or drilling rig. The drilling vessel can be used to drill a series of successively smaller wellbores and install one or more conductors in the wellbores in order to maintain hole integrity and establish well control.

A large open water hole may be drilled or jetted for running a length of conductor connected to a low pressure wellhead housing. Subsequently, a second smaller hole may be drilled within the first into which a length of surface casing connected to a high pressure wellhead housing may be run. These two casing strings can be suspended from wellheads located at the seabed. Once the high pressure wellhead is installed on the seabed, the dedicated drilling vessel may run and install the BOP stack, which may be followed by the installation of a marine riser. From this point forward, a full well control package may be available, which can respond to any wellbore influx, and the cuttings and drilling fluids can be contained in the marine riser. Before the installation of the BOP stack and marine riser, this method of drilling can result in large quantities of drill cuttings and drilling fluids being deposited into the environment, and can be vulnerable to shallow gas encounters. It also relies on the use of equipment such as a rotary table, top drive, derrick etc, which may be available only on a dedicated drilling vessel, and the use of a dedicated drilling vessel or drilling rig can be very costly and time intensive.

As such, it is known to use suction devices to install a conductor casing in the seabed, without the need to drill any holes in the seabed.

Publications which may be useful to understand the background include WO01065050, U.S. Pat. Nos. 4,830,541, 7,025,145 and WO 2015/118348.

SUMMARY

According to the invention we provide an apparatus for installing a wellbore beneath a body of water comprising a support structure, a tubular mounted on the support structure, the tubular having a first end, a second end, and an interior passage which extends from the first end to the second end, a tubular extension releasably mounted on the support structure, the tubular extension having a first end, a second end and an interior passage which extends from the first end to the second end, and a flexible assembly line which extends from the interior passage of the tubular extension to the second end thereof, into the tubular at the first end thereof, and along the interior passage of the tubular to the second end thereof.

The assembly line may be secured to the first end of the tubular extension, and extend along the interior passage to the second end thereof.

The apparatus may further comprise a wellhead which is mounted on the support structure at or adjacent the second end of the tubular, the wellhead enclosing a main passage which is aligned and in communication with the interior passage of the tubular.

The tubular and tubular extension may comprise surface casing. Surface casing is the tubular which extends downwardly from the wellhead housing, and is designed to contain fluid at elevated pressures.

The tubular and tubular extension may comprise conductor casing. Conductor casing has a larger diameter than the wellhead and may be used to provide the initial stable structural foundation for a wellbore. Where used, it is the largest diameter pipe installed in the wellbore and surrounds the surface casing. Unlike the surface casing, the conductor casing need not be configured to high pressure fluid, as fluids flowing from the wellbore will be contained by other casings within the conductor casing.

Where the tubular and tubular extension comprises conductor casing, the tubular may be secured to the support structure via a conductor housing.

Where the tubular and tubular extension comprise conductor casing, the apparatus may further comprise a length of surface casing having an interior passage, the surface casing being mounted inside the interior passage of the tubular so that the interior passage of the surface casing is generally coaxial with the interior passage of the conductor casing and an annulus is provided in the interior passage of the tubular between the tubular and the surface casing. In this case, a centraliser may be mounted in the annulus at or adjacent to the first end of the tubular, the centraliser extending between the surface casing and the tubular to restrict movement of the surface casing relative to the tubular. Also in this case, the surface casing may be secured to the support structure via a wellhead which is mounted on the support structure at or adjacent the second end of the tubular, the interior passage of the wellhead being aligned and in communication with the interior passage of the surface casing. The surface casing may, for example, be suspended from the wellhead via a tubing hanger. Where a conductor housing is provided, the wellhead may be secured to the support housing via the conductor housing.

The support structure may comprise a suction foundation comprising a housing defining a chamber, the housing having an open end which defines a leading edge for engagement with the seabed, the end opposite the open end being closed by a lid so that when the leading edge of the housing is engaged with the seabed, the seabed, lid and housing enclose the chamber.

In this case, the tubular may be secured to the lid of the suction foundation so that the interior passage extends along the chamber towards the open end of the housing, the lid having a port which provides a substantially fluid tight connection between the interior passage of the tubular and the exterior of the housing.

The tubular extension may be releasably mounted on the housing.

The support structure may comprise a well template having a support frame and at least one foundation structure which is configured to engage with the seabed. The foundation structure may comprise a suction foundation, a mud mat or pile. In this case, the tubular may be mounted on the support frame. The tubular extension may be releasably mounted on the support frame.

Where the foundation structure is a suction foundation, the suction foundation may comprise a housing defining a chamber, the housing having an open end which defines a leading edge for engagement with the seabed, the end opposite the open end being closed by a lid so that when the leading edge of the housing is engaged with the seabed, the seabed, lid and housing enclose the chamber. In this case, the tubular extension may be releasably mounted on the housing of the suction foundation.

Where the support structure is a well template, the template may be provided with a plurality of foundation structures which are mounted on the support frame. In this case, the apparatus may be provided with a single tubular which is mounted on the support frame so that the foundation structures are arranged an array around the tubular. Alternatively, the apparatus may comprise a plurality of tubulars all of which are mounted on the support frame.

The assembly line may comprise a cable, wire rope, chain or any other suitable form of flexible elongate element.

The apparatus may further comprise a tensioning apparatus, the assembly line extending from the second end of the tubular to the tensioning apparatus, and the tensioning apparatus being operable to pull the assembly line. The tensioning apparatus may, for example, comprise a winch.

The assembly line may be secured to the first end of the tubular extension. Alternatively, the assembly line may be provided with a load transfer element which is configured to engage with the first end of the tubular extension to prevent the assembly line from being pulled along the interior passage of the tubular extension when a pulling force directed from the first end towards the second end of the tubular extension is applied to the assembly line.

The apparatus may comprise one or more additional tubular extensions each of which is releasably mounted on the support structure, each additional tubular extension having a first end, a second end and an interior passage extending from the first end to the second end, the assembly line extending from the first end of the extension tubular, along the interior passage to the second end thereof, along the passage of each additional tubular extension, into the first end of the tubular, along the interior passage and to the second end thereof.

According to a second aspect of the invention we provide a method of installing a wellbore beneath a body of water using an apparatus according to the first aspect of the invention, the method comprising the steps of:

a) transporting the apparatus on a vessel across the body of water to a desired deployment location,
b) suspending the apparatus from vessel,
c) lowering the apparatus into the body of water,
d) releasing the tubular extensions from their attachment to the support structure, and
e) pulling the assembly line to bring the second end of the tubular extension into engagement with the first end of the tubular,
f) lowering the apparatus through the body of water so that the tubular extension becomes embedded in the ground beneath the body of water.

The method may include connecting the assembly line to a winch prior to lowering the apparatus into the body of water, using the winch to let out the assembly line whilst lowering the apparatus into the body of water, and using the winch to apply a pulling force to the assembly line to bring the second end of the tubular extension into engagement with the first end of the tubular.

The support structure may comprise a suction foundation, and the method include the step of using a suction apparatus to create a pressure differential between an interior and exterior of the suction foundation to assist in driving the apparatus further into the ground beneath the body of water.

BRIEF DESCRIPTION OF THE DRAWINGS

These and other characteristics will become clear from the following description of illustrative embodiments, given as non-restrictive examples, with reference to the attached drawings, in which.

DETAILED DESCRIPTION

Figure 1:
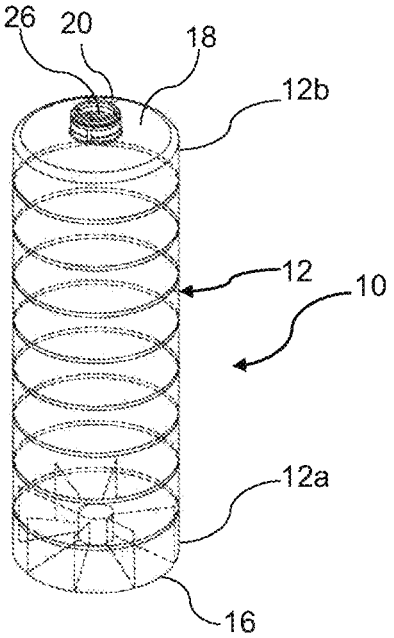
Figure 1 (Prior Art)
FIG. 1 is a perspective view of a suction foundation suitable for use in a wellbore installation apparatus according to the first aspect of the invention.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

Figure 2:
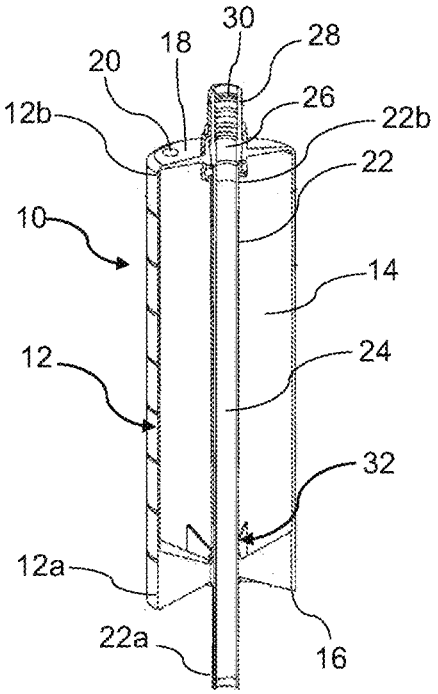
Figure 2 (Prior Art)
FIG. 2 is a perspective view of a longitudinal cross-section through an assembly of the suction foundation illustrated in FIG. 1 with a wellhead housing and a surface casing tubular.

Referring now to FIGS. 1 and 2 there is shown a suction foundation 10 having a housing 12 defining a chamber 14, the housing 12 having an open end 12*a* which defines a leading edge 16 for engagement with the seabed, the end 12*b* opposite the open end 12*a* being closed by a lid 18 so that when the leading edge 16 of the housing 12 is engaged with the seabed, the seabed, lid 18 and housing 12 enclose the chamber 14. A suction port 20 is provided in the lid 18, thus connecting the chamber 14 with the exterior of the housing 12. In use, a suction pump may be connected to the suction port 20 in order to draw fluid out of the chamber 14.

In this embodiment, the housing 12 is cylindrical, and the lid 18 is circular.

Referring to FIG. 2, there is shown a tubular 22 secured to the lid 18 of the suction foundation 10. The tubular 22 is a length of surface casing and has a first end 22*a*, a second end 22*b* and an interior passage 24 which extends from the first end 22*a* to the second end 22*b*. The second end 22*b* of the tubular 22 is secured to the lid 18 such that its interior passage 24 extends along the chamber 14 towards the open end 12*a* of the housing 12. In this embodiment, the tubular 22 is longer than the housing 12, and so the first end 22*a* of the tubular 22 extends out of the open end 12*a* of the housing 12.

The lid 18 has a port 26 which provides a substantially fluid tight connection between the lid 18 and the tubular 22 which allows for fluid communication between interior passage 24 of the tubular 22 and the exterior of the housing 12.

A wellhead housing 28 is secured to the port 26, the wellhead housing 28 enclosing a main passage 30 which is aligned and coaxial with the interior passage 24 of the tubular 22. The wellhead housing 28 may be rigidly fixed to the lid 18 of the housing 12 by means of a mechanical lock, one or more fasteners, by welding, or any other suitable means. Alternatively, the wellhead housing 28 could be integral with the housing 12 of the suction foundation 10.

The second end 22*b* of the tubular 22 may be secured to the lid 18 of the housing 12 directly, or it may be secured to the lid 18 via the wellhead housing 28. In the latter case, the wellhead housing 28 may be provided with a casing hanger to which the second end 22*b* of the tubular 22 is connected. Alternatively, the tubular 22 may be integral with the wellhead housing 28.

Appropriate seals are provided between the wellhead, tubular 22 and lid 18 so that fluid in the chamber 14 cannot leak out of the housing 12 via the port 26 or into the interior passage 24 of the tubular 22, and that fluid flowing along the main passage to the wellhead housing 28 into the interior passage 24 of the tubular 22 cannot leak into the chamber 14.

The port 26 may be provided with a profile which allows for the wellhead housing 28 to be mechanically pre-loaded onto the port 26. The wellhead housing 28 can be a high pressure wellhead such as a slimline rigid lockdown (SRLD) wellhead such as that described in abovementioned U.S. Pat. No. 7,025,145.

Whilst movement of the tubular 22 relative to the housing 12 is substantially prevented by means of its connection to the lid 18 of the housing 12, in this embodiment, the suction foundation 10 is provided with a centraliser 32 which has a plurality of radial centralising members which are coupled to the interior of the housing 12 at the open end 12*a* thereof, and which extend to the tubular 22 to maintain the tubular 22 in a centralised position in which its interior passage 24 is coaxial with the chamber 14. The provision of such a centraliser, and its purpose is described in more detail in abovementioned WO 2015/118348.

The tubular 22 is a high pressure surface casing 22 and may be used to install a conductorless wellhead as described in detail in WO 2015/118348.

Figure 3:
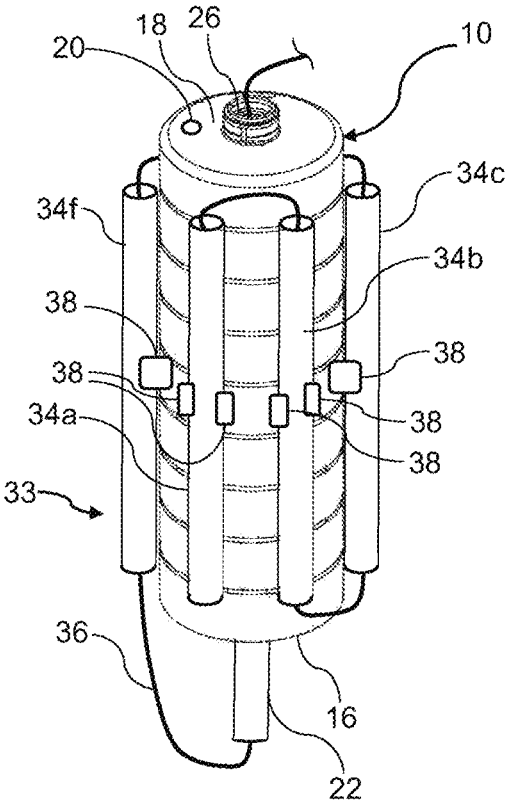
FIG. 3 is a perspective illustration of a first embodiment of wellbore installation apparatus according to the first aspect of the invention.
Figure 4:
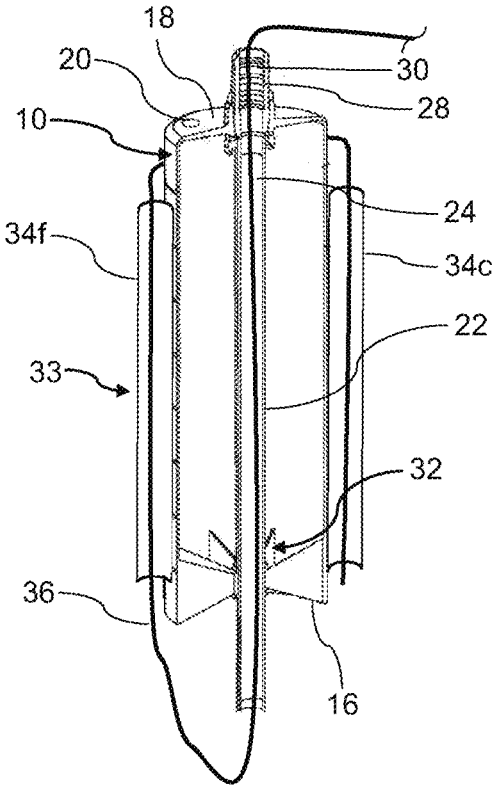
FIG. 4 is a perspective illustration of a longitudinal cross-section through the wellbore installation apparatus illustrated in FIG. 3.
Figure 5:
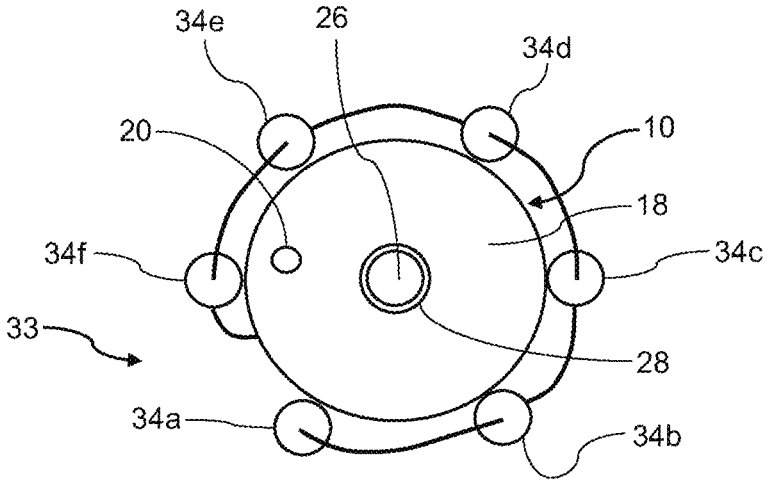
FIG. 5 is a top view of the wellbore installation apparatus illustrated in FIG. 3, FIGS. 6*a* and 6*b* show partial longitudinal cross-sections through the ends of two of the tubular extensions of the apparatus illustrated in FIG. 3, FIGS. 7*a*, 7*b* and 7*c* show partial longitudinal cross-sections through the first end of the first tubular extension of the apparatus illustrated in FIG. 3.

Referring now to FIGS. 3-5, there is shown an apparatus 33 for installing a wellbore beneath a body of water according to the first aspect of invention, which comprises the suction foundation 10, tubular 22 and wellhead housing 28 illustrated in FIGS. 1 and 2. The apparatus 33 additionally comprises a plurality of tubular extensions 34*a*, 34*b*, 34*c*, 34*d*, 34*e*, 34*f* which are releasably mounted on the housing 12 of the suction foundation 10. In this embodiment the tubular extensions 34*a*-34*f* are mounted on the exterior surface of the housing 12, spaced generally regularly around the circumference of the housing 12, as illustrated in FIG. 5.

The tubular extensions 34*a*-34*f* may be mounted on the housing 12 using any suitable attachment device 38, such as a strap or clamp, which may be operated to release the tubular extension 34*a*-34*f* from the housing 12. Advantageously, the attachment device is operable to release the tubular extension 34*a*-34*f* using a tool mounted on and operable by an ROV.

Each tubular extension 34-34*f* has a first end, a second end and an interior passage which extends from the first end to the second end.

The apparatus is also provided with a flexible assembly line 36 which extends from the first end of the first tubular extension 34*a* along the interior passage of the first tubular extension 34*a* to the second end thereof, into the second tubular extension 34*b* at the first end thereof, along the interior passage to the second end thereof, into the third tubular extension 34*c* at the first end thereof, along the interior passage to the second end thereof, and so on, to the second end of the final (in this case the sixth) tubular extension 34*f*, from where it extends into the tubular 22 at the first end 22*a* thereof, and along the interior passage 24 of the tubular 22 to the second end 22*b* thereof. The assembly line 36 then extends out of along the main passage 30 of the wellhead housing 28 to a tensioning apparatus which is operable to pull the assembly line 36.

Advantageously the tubular extensions 34*a*-34*f* are arranged so the second end of each is adjacent the first end of the next, and the first end of each is adjacent the second end of the next. As such, where the assembly line 36 emerges from the second end of one tubular extension, it does not have extend along the length of the next tubular extension before it reaches the first end of the next.

Figure 6A:
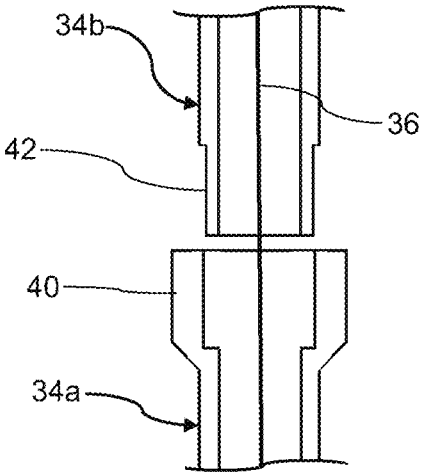
Figure 6B:
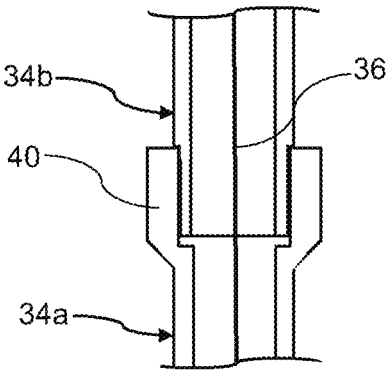

The tubular extensions 34*a*-34*f* are configured to be joined end to end to form a continuous tubular extension. This may be achieved by providing the ends of each tubular extension 34*a*-34*f* with pin and box formations. One way of achieving this is illustrated in FIGS. 6*a* and 6*b*, which show a longitudinal cross-section through the second end of the first tubular extension 34*a* and the first end of the second tubular extension 34*b*. In this embodiment, the box formation 40 (a portion with a larger outer and inner diameter) is provided at the second end of each tubular extension 34*a*-34*f*, and a pin formation 42 (a portion with a smaller outer diameter) is provided at the first end of each tubular extension 34*a*-34*f*. The pin formation 42 is configured to fit into the box formation 40 as illustrated in FIG. 6*b*.

Although not essential, it should be appreciated that locking formations may be provided to lock the two tubular extensions 34*a*-34*f* together when the pin formation 42 of one is inserted into the box formation 40 of another. The locking formations could, for example be a radially outwardly extending lip provided on the pin formation 42 which lodges in a circumferential groove provided on the radially inwardly facing surface of the box formation 40. Alternatively, the locking formations could comprise a snap ring which is located between the pin formation and the box formation, and which lodges in circumferential grooves provided on the radially outward facing surface of the pin formation and the radially inward facing surface of the box formation. Other suitable locking formations will be well known to the skilled person.

In this embodiment, the tubular extensions 34*a*-34*f* are also lengths of surface casing, and are configured to be joined to the tubular 22 to form an extension thereof. To facilitate this, the first end 22*a* of the tubular 22 is also provided with a pin formation which is configured to mate with the box formation 40 at the second end of the final tubular extension 34*f*.

It will, of course, be appreciated that the box formations could be provided at the first ends of the tubular 22 and tubular extensions 34*a*-34*f* and the pin formations provided at the second ends of the tubular extensions 34*a*-34*f*.

Advantageously, each tubular extension 34*a*-34*f* is provided with a sealing assembly which is configured to ensure a substantially fluid tight seal between the ends of the adjacent tubular extensions 34*a*-34*f* and between the first end 22*a* of the tubular 22 and the final tubular extension 34*f* when they are joined to form a continuous tubular extension. Each sealing assembly could, for example, comprise one or more O-rings which is/are located between the radially outward facing surface of the pin formation and the radially inward facing surface of the box formation.

The pin and box formations may be configured to allow for some relative axial movement of adjacent tubular extensions 34*a*-34*f* whilst the pin formation is still within the box formation, and where a sealing assembly is provided, whilst still maintaining sealing engagement between the adjacent tubular extensions 34*a*-34*f*.

The assembly line 36 may comprise a hose, cable, wire rope, chain or any other suitable form of flexible elongate element. It may be secured to the first end of the first tubular extension 34*a*. Alternatively, the assembly line 36 may be provided with a load transfer element which is configured to engage with the first end of the first tubular extension 34*a* to prevent the assembly line 36 from being pulled along the interior passage of the first tubular extension 34*a* when a pulling force directed from the first end towards the second end of the tubular extension 34*a* is applied to the assembly line 36.

Figure 7A:
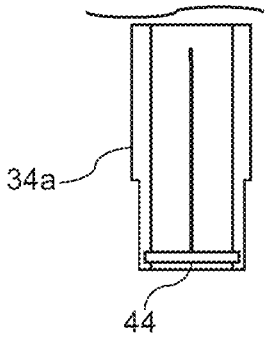

The assembly line 36 may, for example be secured to an anchor plate 44 which is lodged in a circumferential groove provided in the interior face of the first end of the first tubular extension 34*a* as illustrated schematically in FIG. 7*a*.

Figure 7B:
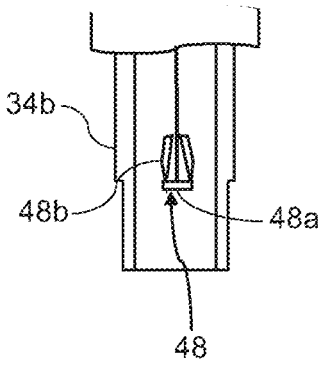
Figure 7C:
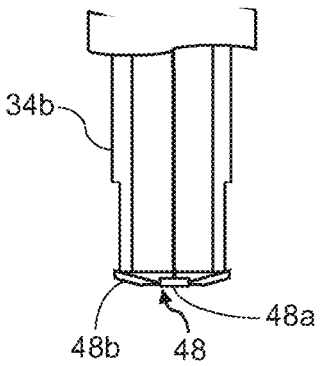

The assembly line 36 may, alternatively be provided with an anchor device which has a larger diameter than the first end of the first tubular extension and which is located at the first end of the first tubular extension but outside of the interior passage. The anchor device 48 could also be a plate or it could be a collapsable device with a central hub 48*a* from which radiate a plurality of spokes or interlocking fins 48*b*, as illustrated in FIGS. 7*b* and 7*c*. In this embodiment, the radially extending spokes or fins 48*b* are pivotally connected to the central hub such that they can be pivoted through approximately 90° between a collapsed position and an expanded position. In this case, the assembly line 36 could be secured to the central 1*o* hub 48*a* and the assembly line 36 inserted into the interior passage of the first tubular extension with the anchor device in its collapsed configuration, as illustrated in FIG. 7*b*. The assembly line 36 could be lowered down the interior passage of the first tubular extension 34*a* until the anchor device 48 passes out of the first end thereof. At this point it may be moved to its expanded configuration, the spokes or fins thus engaging with the first end of the first tubular extension, as illustrated in FIG. 7*c*, to prevent the assembly line 36 from being pulled back along the interior passage.

The anchor plate 44, or anchor device 48 may be provided with a plurality of perforations.

The apparatus 33 may be used to install a wellbore beneath a body of water as follows. The apparatus is loaded onto a vessel 50 in the configuration illustrated in FIGS. 3 and 4, with the wellhead 28, tubular 22, tubular extensions 34*a*-34*f* and assembly line 36 in place, and transported on the vessel to the desired deployment site. In this embodiment, the body of water is the ocean, and the apparatus is used to install a wellbore in the seabed. It should be appreciated, however, that it could equally be used to install a wellbore in the ground beneath another body of water such as a lake or reservoir.

Prior to deployment, the assembly line 36 is secured to a tensioning apparatus, in this embodiment a winch 52, provided on the surface vessel 50, so that the assembly line 36 extends from the main passage 30 of the wellhead 28 to the winch 52. The port 20 in the lid 18 of the suction foundation 10 is connected to a suction device 58 via an umbilical.

Figure 8:
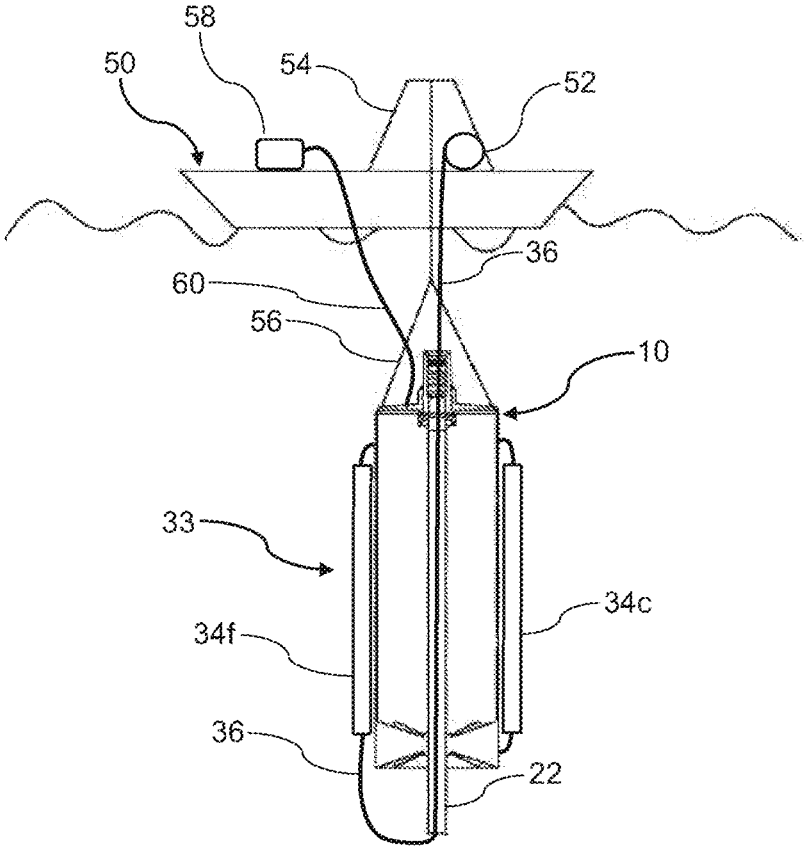
FIG. 8 is a schematic illustration of how the apparatus illustrated in FIG. 3 may be deployed to install a wellbore, and shows the apparatus prior to release of the tubular extensions.

The suction foundation 10 is mounted on a crane or similar hoisting apparatus 54 provided on the vessel 50 by one or more tethers, lines, chains 56 or the like, and the hoisting apparatus 54 operated to lower the apparatus 33 over the side of the vessel 50 into the ocean as illustrated in FIG. 8. The winch 52 may, if necessary, be operated to let out the assembly line 36 as the apparatus 33 is lowered into the sea.

Figure 9:
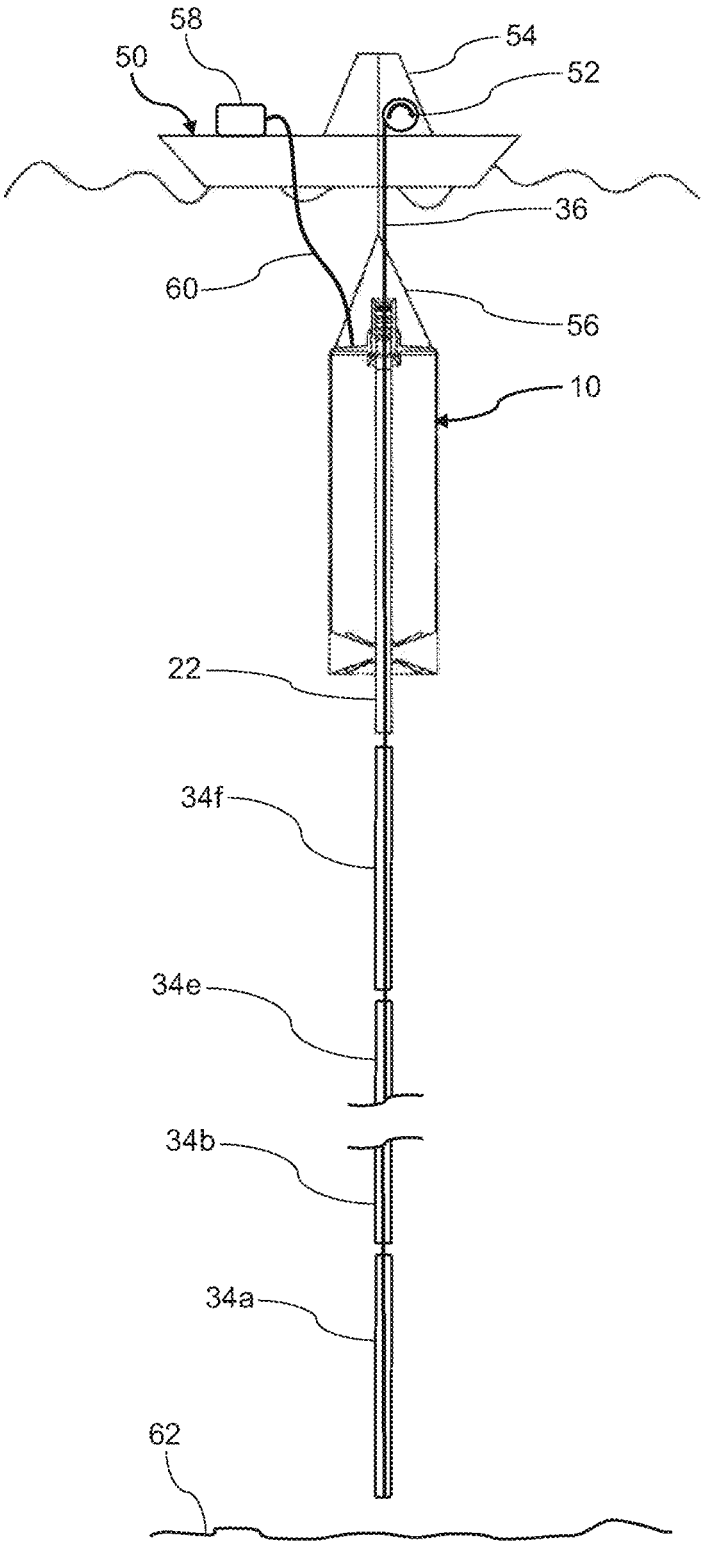
FIG. 9 is a schematic illustration of how the apparatus illustrated in FIG. 3 may be deployed to install a wellbore, and shows the apparatus after release of the tubular extensions.

The attachment devices 38 are then operated, for example, using an ROV, to release the tubular extensions 34*a*-34*f* from the housing 12 of the suction foundation 10. Advantageously, the tubular extensions are released sequentially—the first tubular extension 34*a* being released first, followed by the second, the third etc, and the final tubular extension 34*f* being released last. This will cause the tubular extensions 34*a*-34*f* to cascade downwards until they are suspended from the assembly line 36, the first tubular extension 34*a* being lower most, followed by the second, the third etc., until the final tubular extension 34*f* is suspended directly below the tubular 22 as illustrated in FIG. 9. Each tubular extension 34*b*-34*f* apart from the first, is free to move along the assembly line 36, and so each will slide down the line until its first end engages with the second end of the tubular extension below. Where the tubular extensions are provided with pin and box formations as described above, the ends of the adjacent tubular extensions will interlock as illustrated in FIG. 6*b*. It may be necessary to provide each box formation with a guide (which could be conical) to assist in guiding each pin formation into the adjacent box formation.

The winch 52 may then be operated to pull the assembly line 36 onto the vessel 50. This will cause the first tubular extension 34*a* to move towards the first end 22*a* of the tubular 22. Operation of the winch 52 is stopped when the second end of the final tubular extension 34*f* engages with the first end of the tubular 22, and where pin and box formations are provided, the pin formation at the first end 22*a* of the tubular 22 lodges in the box formation at the second end of the final tubular extension. The tubular 22 and tubular extensions 34*a*-34*f* now form a continuous length of surface casing which is significantly longer than the housing 12 of the suction foundation 10.

Operation of the hoisting apparatus 54 is then recommenced to lower the apparatus 33 towards the seabed 62. If the tubular extensions 34*a*-34*f* are provided with locking formations which are sufficiently robust to support the weight of the surface casing, the assembly line 36 may be released before the apparatus 33 is lowered. If not, the winch 52 will be operated to let out the assembly line 36 as the apparatus 33 is lowered, at a suitable rate to maintain tension in the assembly line 36 and engagement between the ends of adjacent tubular extensions 34*a*-34*f*. It may also be necessary to let out the umbilical 60 as the apparatus 33 is lowered.

When the first end of the first tubular extension 34*a* reaches the seabed 62, the weight of the apparatus 33 may be sufficient to cause the tubular extensions 34*a*-34*f* to penetrate into the seabed 62 as the lowering of the apparatus 33 continues. It may, however, be necessary to assist the penetration of the tubular extensions 34*a-f* into the seabed 62, for example to avoid buckling of the tubular extensions 34*a-f*. This may, for example, be the case for harder seabed soils and/or when the tubular extensions 34*a-f* have longer lengths. In one example, one may use a process known as "jetting" to assist the movement of the tubular extensions 34*a*-34*f* down into the seabed 62. In this process, pressurised water is pumped down the tubular 22 and tubular extensions 34*a*-34*f*, so that a jet or jets of pressurised water exit the extended length of surface casing formed by the tubular 22 and tubular extensions 34*a*-34*f* at the first end of the first tubular extension 34*a*. The perforations in the anchor plate 44 or anchor device 48, are provided to allow the pressurised water to escape from the surface casing during jetting. Where the assembly line 36 is a hose, the pressurised water could, instead, be pumped down the assembly line 36 to the first end of the first tubular extension 34*a*. In this case, the end of the assembly line 36 is provided with a nozzle through which the pressurised water is ejected. The nozzle may, for example, form part of the anchor plate 44 or anchor device 48, or be attached thereto.

Alternatively, or additionally the penetration of the tubular extensions 34*a*-34*f* into the seabed could be assisted by the provision of a mud recovery apparatus which is connected to the passage enclosed by the extended length of surface casing formed by the tubular 22 and the tubular extensions 34*a*-34*f* and which is operable to suck soil/silt/mud up and out of the surface casing as the tubular extensions 34*a*-34*f* move downwards into the seabed.

Alternatively or additionally, the penetration of the tubular extensions 34*a*-34*f* into the seabed could be assisted by the provision of a drilling machine at the first end of the first tubular extension 34*a*. Where the assembly line 36 is a hose, the drilling machine could be operated by the pumping of pressurised hydraulic fluid down the assembly line 36 to the drilling machine.

A combination of these techniques could be employed. For example, where the assembly line 36 is a hose, jetting could be carried out by pumping pressurised water down the assembly line 36, and the jetted out soil/silt/mud removed via a mud recovery apparatus connected to the interior of the extended length of surface casing formed by the tubular 22 and the tubular extensions 34*a*-34*f*, or drilling carried out using a drilling machine and the drilling out soil/silt/mud removed via a 1*o* mud recovery apparatus connected to the interior of the extended length of surface casing formed by the tubular 22 and the tubular extensions 34*a*-34*f*.

By appropriate control of the speed of lowering of the apparatus and using these methods of assisting the penetration of the tubular extensions 34*a*-34*f*, the risk of the tubular extensions 34*a*-34*f* buckling can be minimised. It will be appreciated, however, that waves and the swell of the ocean could cause significant fluctuations in the downward force experienced by the tubular extensions 34*a*-34*f* from the weight of the remainder of the apparatus, even if a heave compensation system is provided on the hoisting apparatus. The risk of buckling may be further mitigated by configuring the pin and box formations to allow for some relative axial movement of adjacent tubular extensions 34*a*-34*f*, as this will allow the total length of the casing formed by tubular extensions 34*a*-34*f* to increase and decrease slightly as the apparatus 33 is lowered.

Eventually, the leading edge 16 of the suction housing 12 will reach the seabed 62, and a seal will be formed between the housing 12 and the seabed 62. At this point the suction foundation 10 may be operated to provide an additional force pushing the surface casing into the seabed 62, as is described in detail in abovementioned WO 2015/118348, for example. The suction device 58 is operated to draw water out of the chamber 14 of the housing 12 to create an underpressure or vacuum in the chamber 14. This creates a pressure differential between the fluid in the chamber 14 and the fluid at the exterior of the housing 12 which drives or forces the apparatus downwards into the seabed 62.

This is continued until the apparatus 33 is at the desired depth in the seabed 62. The umbilical 60 can then be disconnected from the port 20 and reeled back onto the vessel 50. The assembly line 36 can then also be reeled back onto the vessel 50. To facilitate this, the load transfer element which connects the assembly line 36 to the first end of the first tubular extension 34*a* may be configured to release the assembly line 36 from the first tubular extension 34*a* when the applied pulling force exceeds by a predetermined amount the force exerted by the tubular extensions 34*a*-34*f* on the assembly line 36 when the assembly line 36 is tensioned to bring the tubular extensions 34*a*-34*f* together with the tubular 22 to form the extended continuous length of surface casing. This could be achieved by the use of one or more shear pins (either to connect the load transfer element to the assembly line 36 or to connect the load transfer element to the first tubular extension 34*a*). Where the load transfer element is an anchor device 48 as illustrated in FIGS. 7*b* and 7*c*, this could be achieved by configuring the device 48 such that the spokes or fins 48*b* collapse and fold downwardly when the pulling force on the assembly line 36 exceeds a predetermined level, or by configuring the device 48 such that the spokes or fins 48*b* fold upwards to the configuration illustrated in FIG. 7*c* when the pulling force on the assembly line 36 is released, thus allowing the anchor device 48 to be pulled back up the tubular extensions 34*a*-34*f*.

The wellhead housing 28 is then ready to receive a BOP stack and marine riser, and normal drilling operations can now commence.

Whilst in the embodiment described above, the umbilical 60 is connected to the port on board the vessel 50, this need not be the case. The umbilical 60 could, instead, be connected using an ROV when the leading edge 16 of the suction housing 12 reaches the seabed 62.

By virtue of the provision of the tubular extensions 34*a*-34*f*, the surface casing can reach a greater depth in the seabed 62 before the start of normal drilling operations.

It will be appreciated that the number and length of the tubular extensions 34*a*-34*f* may be varied depending on the nature of the seabed 62 at the desired deployment location. If the top soft layer of the seabed 62 is likely to be relatively shallow, only one tubular extension 34*a* may be used, whilst more may be used if the soft top layer is deeper.

If the nature of the seabed 62 is such that it is not possible to use this method to install as long a length of surface casing as is desired, it may be necessary to further extend the surface casing by conventional drilling operations. In this case, the first tubular extension 34*a* may by provided with a casing hanger interface from which additional lengths of casing may be hung as drilling progresses.

Figure 10:
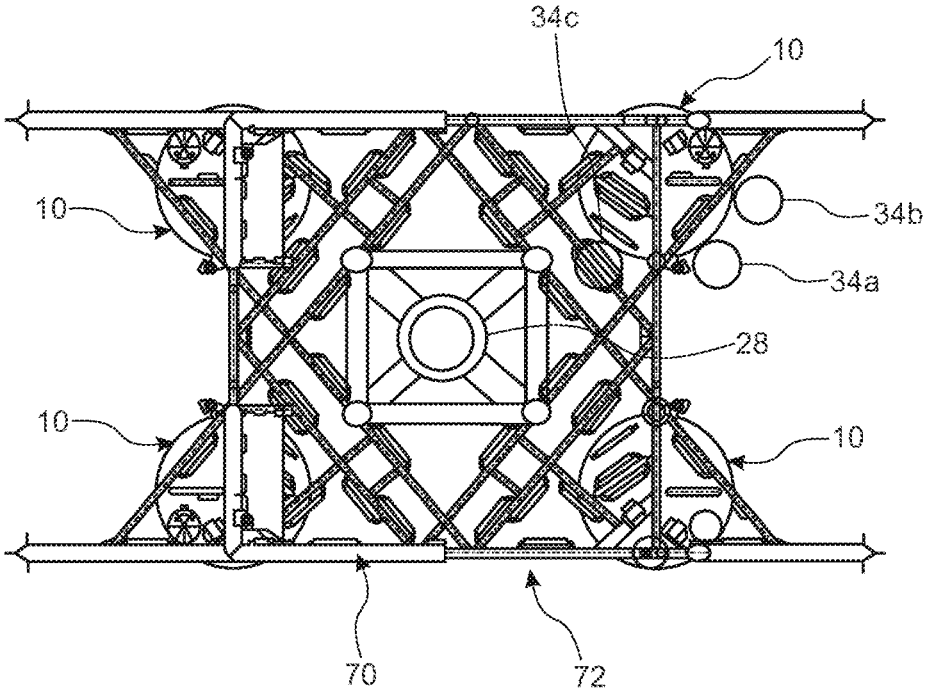
FIG. 10 is a top view of an alternative embodiment of wellbore installation apparatus according to the first aspect of the invention.
Figure 11:
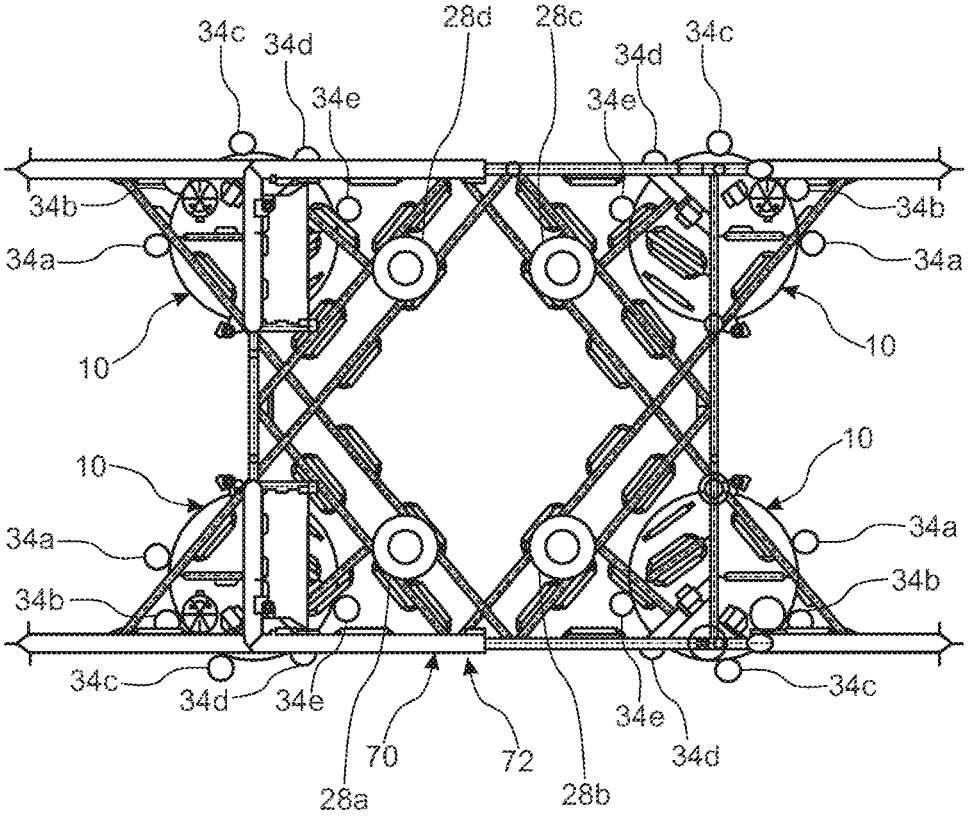
FIG. 11 is a top view of a further alternative embodiment of wellbore installation apparatus according to the first aspect of the invention

In an alternative embodiment of the invention, the tubular 22 is mounted on the support frame 70 of a well template 72, as illustrated in FIGS. 10 and 11.

In the embodiment illustrated in FIG. 10, the well template 72 is provided with four suction foundations 10 which are arranged in a generally rectangular array, with the tubular 22 and wellhead housing 28 being mounted on the support frame 70 centrally between the suction foundations 10. In this embodiment, only three tubular extensions 34*a*, 34*b*, 34*c* and these are releasably mounted on the housing 12 of one of the four suction foundations 10 in the same way as described in relation to FIGS. 3-9 above.

In the embodiment illustrated in FIG. 11, the well template 72 is also provided with four suction foundations 10 which are arranged in a generally rectangular array, but the apparatus 33 includes four tubulars and wellhead housings 28*a*-28*d* which are mounted on the support frame 70 centrally between the suction foundations 10 in a smaller rectangular array. In this embodiment, each tubular is provided with an assembly line 36, and five tubular extensions 34*a*, 34*b*, 34*c*, 34*d*, 34*e* which are releasably mounted on the housing 12 of the adjacent suction foundation 10, with the assembly line 36 passing through them, in the same way as described in relation to FIGS. 3-9 above.

Figure 12:
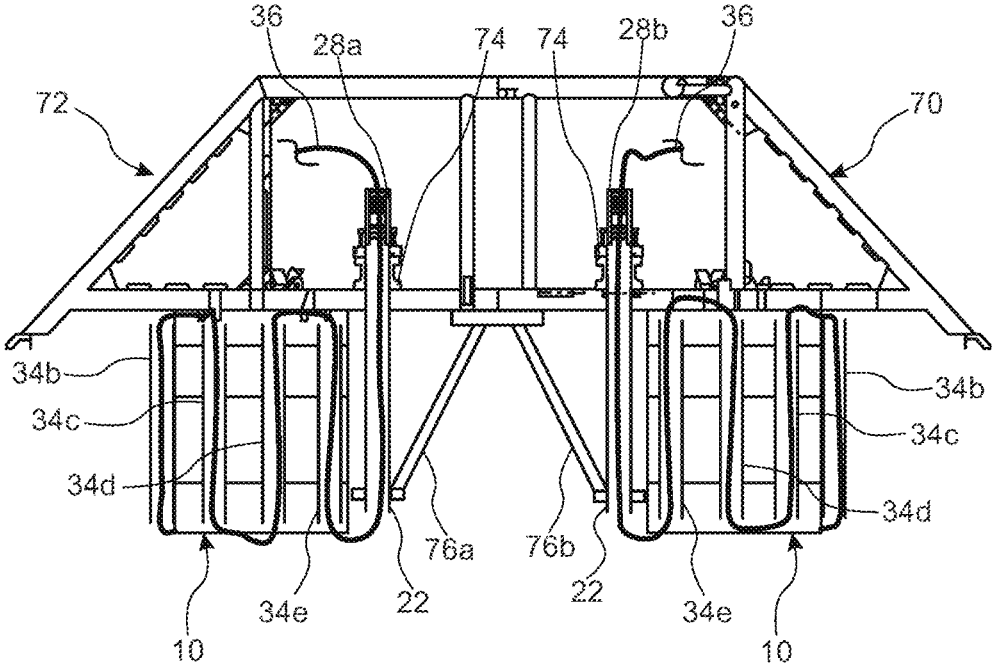
FIG. 12 is a side view of the embodiment of wellbore installation apparatus illustrated in FIG. 11.

A side view of the embodiment illustrated in FIG. 11 is shown in FIG. 12, and this shows how the assembly line 36 extends from the tubulars 22 to the tubular extensions 34*a*-34*e*. The wellhead housings 28*a*-28*d* may be secured to the support frame 70 using any suitable fixed means. For example, they may be welded, clamped or bolted onto the support frame 70. In this embodiment, each wellhead housing 28*a*-28*d* is secured to the support frame 70 via a tubular adapter 74.

In this embodiment the well template 72 is provided with four tubular support struts 76*a*, 76*b* which each extend from the support frame 70 to engage with the first end 22*a* of one of the tubulars 22, and assist in preventing or minimising lateral movement of the tubular 22 with respect to the support frame 70.

Figure 13:
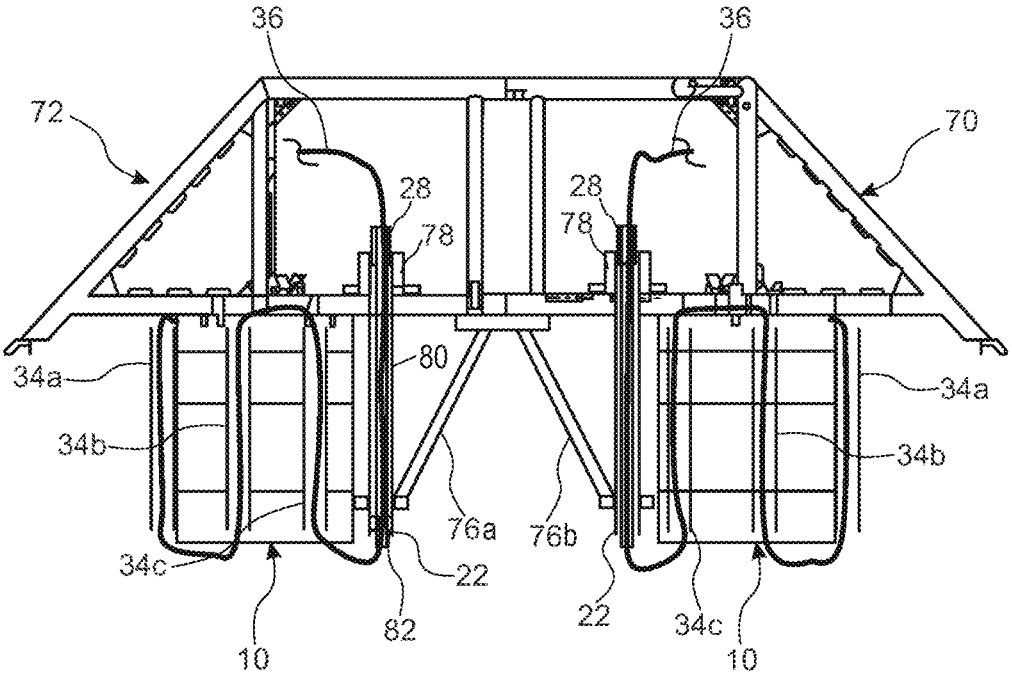
FIG. 13 is a side view of a further alternative embodiment of wellbore installation apparatus according to the first aspect of the invention.

In the embodiments described above, each tubular 22 and set of tubular extensions 34*a*-34*f* form a length of high pressure surface casing. This need not be the case, however, and the tubular 22 and tubular extension 34*a*-34*f* may, instead, form a conductor casing as illustrated in FIG. 13. In this embodiment, there are four tubulars 22 mounted on a well template, just as described above in relation to FIGS. 11 and 12, and each tubular 22 is provided with three tubular extensions 34*a*, 34*b*, 34*c* which are all releasable mounted on the housing 12 of an adjacent suction foundation 10.

In this case, each tubular 22 is secured to the support frame 70 via a conductor housing 78 which is secured to the support frame 70 using any suitable fixed means. For example, they may be welded, clamped or bolted onto the support frame 70. Each tubular 22 is suspended from or integral with one of the conductor housings 78.

Each wellhead housing 28 is mounted one of the conductor housings 78, and a length of surface casing 80 secured to the wellhead housing 28 to extend down the interior passage of the tubular 22 so that the surface casing 80 is coaxial with the tubular 22. The surface casing 80 may be suspended from the wellhead housing 28 via an interface part such as a tubing hanger.

An annulus is provided in the interior passage of the tubular 22 between the tubular 22 and the surface casing 80. In this embodiment, although not essential, a centraliser 82 is mounted in the annulus at the first end 22*a* of the tubular 22, the centraliser 82 extending between the surface casing 80 and the tubular 22 to restrict movement of the surface casing 80 relative to the tubular 22.

All other aspects of this embodiment are the same as the embodiments illustrated in FIGS. 1-12.

Figure 14:
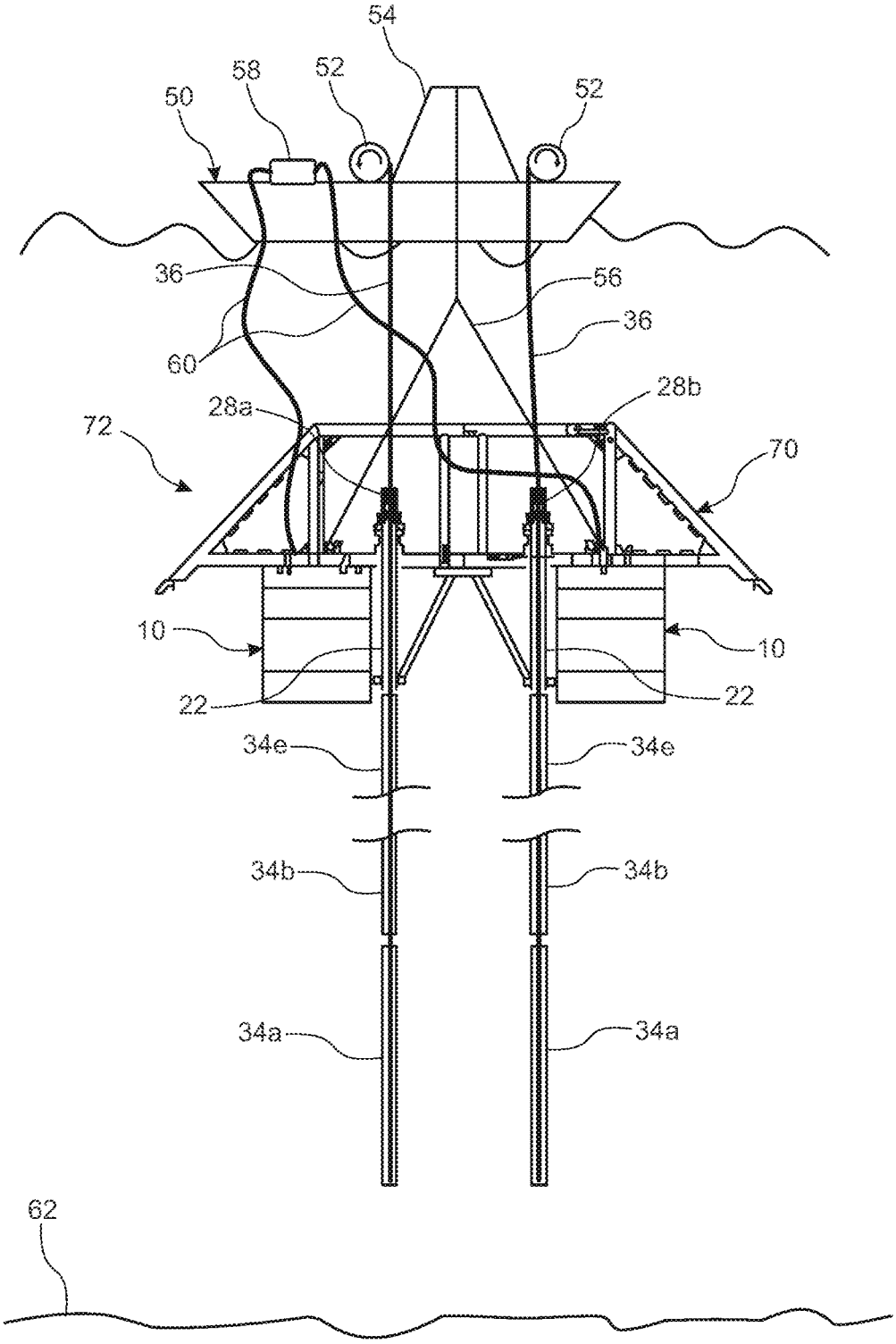
FIG. 14 is a schematic illustration of how the apparatus illustrated in FIGS. 11 and 12 may be deployed, and shows the apparatus after release of the tubular extensions.

The embodiments illustrated in FIGS. 10-13 may be deployed in a very similar way to the embodiments illustrated in FIGS. 3-9, except that the hoisting apparatus 54 is secured to the support frame 70 of the well template 72, so that it can be operated to lower the entire well template 72 into the sea as illustrated in FIG. 14. Each assembly line 36 is attached to a separate winch 52 so that the process of releasing the set of tubular extensions 34*a*-34*e* associated with each tubular 22 may be carried out simultaneously. The tubular extensions 34*a*-34*e* could, however, be released one set at a time. In this embodiment, one suction apparatus 58 is connected to each suction foundation 10. It would, however, be possible to provide a separate suction apparatus 58 for each suction foundation 10.

Once all the tubular extensions 34*a*-34*e* are released, and the assembly line 36 pulled taut to bring the ends of the tubulars 22 and tubular extensions 34*a*-34*e* into engagement, the lowering of the well template 72 is continued to drive the tubulars and suction foundations 10 into the seabed 62 just as described above.

Where a well template 72 is used, whilst in the embodiments described above the or each tubular 22 is mounted on the support frame 70, and the tubular extensions 34*a*-34*e* are mounted on the housing 12 of the suction foundations 10, this need not be the case. For example, the or each tubular 22 may be mounted on the suction foundation housing 12 as described above in relation to the embodiment illustrated in FIGS. 3 and 4. Alternatively both the tubulars 22 and the tubular extensions 34*a*-34*e* may be mounted on the support frame 70.

It is possible that, after the lowermost end of the lowest tubular extension 34*a* has engaged with and started to embed in the seabed 62, the vessel 50 and/or the suction foundation 10/well template 72 could move or drift horizontally, so that the or each length of surface or conductor casing no longer extends upwards from the seabed 62 along a straight vertical line. If the surface/conductor casing has only just started to penetrate the seabed 62, this could cause the surface/conductor casing to be pushed into the seabed 62 in a non-vertical orientation. Alternatively, or additionally, this could cause the surface/conductor casing to bend, particularly if the surface/conductor casing is embedded deeply in the seabed 62 when the horizontal drift occurs.

In either event, this could put significant strain on the connection between the or each tubular 22 and the lid 18 of the suction anchor 10 or the well template 72. This could be mitigated by connecting the tubular 22 to the suction anchor 10 or wellhead template using a wellhead support structure such as that described in WO2022/265516.

Horizontal drift of the suction foundation 10 or well template 72 could also be eliminated or minimised by the use of a temporary guide system which extends from the suction foundation 10 or well template 72 to the sea bed 62. This temporary guide system could comprise temporary suction anchors or clump weights which are positioned on the sea bed 62 around the desired landing point for the surface/conductor casing (prior to touchdown of the lowermost tubular extension 34*a* on the seabed 62), and which are connected to the suction foundation 10 or well template 72 via a plurality of guide wires.

Whilst in the embodiments described in relation to figures above, the foundation structures are suction foundations, this need not be the case and the or each foundation structure may comprise a suction foundation, a mud mat or pile.

The invention is not limited by the embodiments described above; reference should be had to the appended claims.

The invention claimed is:

1. An apparatus for installing a wellbore beneath a body of water comprising a support structure, a tubular mounted on the support structure, the tubular having a first end, a second end, and an interior passage which extends from the first end to the second end, a tubular extension releasably mounted on the support structure, the tubular extension having a first end, a second end, and an interior passage which extends from the first end to the second end, and a flexible assembly line which extends from the interior passage of the tubular extension to the second end thereof, into the tubular at the first end thereof, and along the interior passage of the tubular to the second end thereof, wherein the assembly line is secured to the first end of the tubular extension and extends along the interior passage to the second end thereof.

2. The apparatus according to claim 1, wherein the apparatus further comprises a wellhead housing which is mounted on the support structure at or adjacent the second end of the tubular, the wellhead housing enclosing a main passage which is aligned and in communication with the interior passage of the tubular.

3. The apparatus according to claim 1, wherein the tubular and the tubular extension comprise surface casing.

4. The apparatus according to claim 1, wherein the tubular and the tubular extension comprise conductor casing.

5. The apparatus according to claim 4, wherein the tubular is secured to the support structure via a conductor housing.

6. The apparatus according to claim 5, wherein the apparatus furthers comprise a length of surface casing having an interior passage, the surface casing being mounted inside the interior passage of the tubular so that the interior passage of the surface casing is generally coaxial with an interior passage of the conductor casing and an annulus is provided in the interior passage of the tubular between the tubular and the surface casing.

7. The apparatus according to claim 6, wherein a centraliser is mounted in the annulus at or adjacent to the first end of the tubular, the centraliser extending between the surface casing and the tubular to restrict movement of the surface casing relative to the tubular.

8. The apparatus according to claim 7, wherein the surface casing is secured to the support structure via a wellhead which is mounted on the support structure at or adjacent a second end of the conductor casing, the interior passage of the wellhead being aligned and in communication with the interior passage of the surface casing.

9. The apparatus according to claim 8, wherein the wellhead is secured to the support housing via the conductor housing.

10. The apparatus according to claim 1, wherein the tubular extension is releasably mounted on a housing.

11. The apparatus according to claim 1, wherein the support structure comprises a well template having a support frame and at least one foundation structure which is configured to engage with the seabed.

12. The apparatus according to claim 11, wherein the foundation structure comprises one of a suction foundation, a mud mat or pile.

13. The apparatus according to claim 11, wherein the foundation structure is a suction foundation, the suction foundation comprising a housing defining a chamber, the housing having an open end which defines a leading edge for engagement with the seabed, the end opposite the open end being closed by a lid so that when the leading edge of the housing is engaged with the seabed, the seabed, lid, and housing enclose the chamber, the tubular being mounted on the support frame and the tubular extension being releasably mounted on the housing of the suction foundation.

14. The apparatus according to claim 11, the apparatus comprising a plurality of tubulars all of which are mounted on the support frame.

15. The apparatus according to claim 1, further comprising a tensioning apparatus, the assembly line extending from the second end of the tubular to the tensioning apparatus, and the tensioning apparatus being operable to pull the assembly line.

16. The apparatus according to claim 1, wherein the assembly line is secured to the first end of the tubular extension.

17. The apparatus according to claim 1, wherein the assembly line is provided with a load transfer element which is configured to engage with the first end of the tubular extension to prevent the assembly line from being pulled along the interior passage of the tubular extension when a pulling force directed from the first end towards the second end of the tubular extension is applied to the assembly line.

18. The apparatus according to claim 1, further comprising one or more additional tubular extensions each of which is releasably mounted on the support structure, each additional tubular extension having a first end, a second end, and an interior passage extending from the first end to the second end, the assembly line extending from the first end of the tubular extension, along the interior passage to the second end thereof, along the passage of each additional tubular extension, into the first end of the tubular, along the interior passage and to the second end thereof.

19. A method of installing a wellbore on the seabed using an apparatus according to the first aspect of the invention, the method comprising the steps of:

a) transporting the apparatus on a vessel across a body of water to a desired deployment location, b) suspending the apparatus from vessel, c) lowering the apparatus into the body of water, d) releasing the tubular extensions from their attachment to the support structure, e) pulling the assembly line to bring the second end of the tubular extension into engagement with the first end of the tubular, and f) lowering the apparatus through the body of water so that the tubular extension becomes embedded in the ground beneath the body of water, wherein the support structure of the apparatus comprises a suction foundation, and the method includes the step of using a suction apparatus to create a pressure differential between an interior and exterior of the suction foundation to assist in driving the apparatus further into the ground beneath the body of water.

20. The method according to claim 19, further comprising connecting the assembly line to a winch prior to lowering the apparatus into the body of water, using the winch to let out the assembly line whilst lowering the apparatus into the body of water, and using the winch to apply a pulling force to the assembly line to bring the second end of the tubular extension into engagement with the first end of the tubular.

* * * * *